United States Patent [19]

Liotta

[11] 4,259,167

[45] Mar. 31, 1981

[54] FORMATION OF CAKING COALS

[75] Inventor: Ronald Liotta, Clark, N.J.

[73] Assignee: Exxon Research and Engineering Co., Florham Park, N.J.

[21] Appl. No.: 69,059

[22] Filed: Aug. 23, 1979

Related U.S. Application Data

[63] Continuation-in-part of Ser. No. 969,353, Dec. 14, 1978, abandoned.

[51] Int. Cl.[3] ..... C10G 1/00; C10G 1/06; C10B 57/04; C10L 0/00

[52] U.S. Cl. ..... 208/8 LE; 208/9; 201/20; 44/1 R

[58] Field of Search ..... 208/8 LE, 9; 201/20; 44/1 R

[56] References Cited

U.S. PATENT DOCUMENTS

| | | | |
|---|---|---|---|
| 2,378,762 | 6/1945 | Frey | 208/46 |
| 3,992,432 | 11/1976 | Napier et al. | 260/465.1 |
| 4,059,410 | 11/1977 | Schlosberg et al. | 44/1 R |
| 4,072,475 | 2/1978 | Schlosberg et al. | 44/1 R X |
| 4,089,772 | 5/1978 | Gorbaty et al. | 208/8 LE |
| 4,092,235 | 5/1978 | Schlosberg et al. | 208/8 LE |

FOREIGN PATENT DOCUMENTS

| | | |
|---|---|---|
| 851191 | 5/1977 | Belgium . |
| 2634419 | 10/1977 | Fed. Rep. of Germany . |

OTHER PUBLICATIONS

Brändström et al., Acta Chem. Scand. 23 (1969) No. 6.
Wagenknecht et al., Synthetic Communication 2(4), pp. 45–219 (1972).
A. McKillop et al., Tetrahedron vol. 30, pp. 1379–1382 (1974).
Bashall et al., Tetrahedron Letters No. 40, pp. 3489–3490 (1975).
Dehmlow et al., Tetrahedron Letters No. 2, pp. 95–96 (1976).
Blom et al., Fuel 36, 135 (1957).
Yohe et al., J.A.C.S. vol. 69, pp. 2644–2648.
Sternberg et al., Fuel 53, pp. 172–175 (1974).
Heathcoat et al., J.C.S. 1932, pp. 2839–2843.
Kröger et al., Erdöl und Kohle Erdgas Petrochemie 18 JAHRG, NR 5.
Sokolova, Chem. Ab. vol. 48, p. 3672i (1954).
Fugassi, Coal, 1962, p. 4946.
Hodek et al., Fuel, 1973, vol. 52, Jul., pp. 220–225.
Hodek et al., ACS Div. of Pet. Chem., 22(2), p. 462 (1977).
Olleman, Analytical Chem., vol. 24, No. 9, Sep. 1952.
Nozum DAR et al., Fuel 36, pp. 254–256 (1957).
Vandi et al., J. of Ind. Chem. Soc., Ind. & New Ed., vol. 20, No. 2 (1957).
Vandi et al., Jour. of Indian Chem. Soc., Ind. & News Ed., vol. 20, #3 & 4 (1957).
Roy et al., J. Sci. Industr. Res., vol. 18B, Nov. 1959, pp. 492–493.
Banerjee et al., J. Sci. Ind. Research 19B (1960).
Sen et al., J. Sci. & Ind. Research, India, 19B (1960).

*Primary Examiner*—Delbert E. Gantz
*Assistant Examiner*—William G. Wright
*Attorney, Agent, or Firm*—D. W. Collins; Henry E. Naylor

[57] ABSTRACT

Highly caking coals are formed by selective oxygen-alkylation or oxygen-acylation of moderately, weakly or non-caking coals, employing a phase transfer reaction which chemically alters phenolic and carboxylic functional substituents. These two very polar functional groups are converted to relatively non-polar ethers and esters, respectively. The O-alkylation or O-acylation is carried out in a binary liquid phase solution (organic and water phases with a solid phase suspended in the medium). A quaternary ammonium or phosphonium salt is reacted with alkali or alkaline earth base to produce the corresponding quaternary ammonium or phosphonium base (an example of a phase transfer reagent). This quaternary base is non-nucleophilic and readily removes the phenolic and carboxylic protons but does little else to the coal structures. After the removal of the weakly acidic protons by the quaternary base, the phenoxides and carboxylates which are produced then undergo O-alkylation or O-acylation. The alkylating or acylating agent comprises a carbon-bearing functional group and a displaceable leaving group.

The process of the invention produces caking properties in non-caking subbituminous coals and increases the caking ability of weakly or moderately caking coals. An important aspect of this invention concerns the coal liquids and gases which are produced during coke formation. The pyrolysis which forms the coke of the O-alkylated or O-acylated coal also produces higher quality coal liquids and gases.

25 Claims, No Drawings

FORMATION OF CAKING COALS

CROSS-REFERENCE TO RELATED APPLICATIONS

This is a continuation-in-part of Ser. No. 969,353, filed Dec. 14, 1978, now abandoned.

BACKGROUND OF THE INVENTION

1. Field of the Invention

This invention is directed (1) to improving the properties of coals and in particular to converting a moderately, weakly or non-caking coal into a highly caking coal and (2) to improving the properties of coal liquids and gases which are produced during the coke formation. This invention is also directed to improving the quality and increasing the quantity of solvent-extracted coal liquids.

2. Description of the Prior Art

Formation of coke from moderately, weakly or non-caking coals usually involves the physical mixing or blending of a binder material into the coal prior to pyrolysis to increase or produce caking properties. This material helps to agglomerate the coal into a molten plastic or liquid state when it is heated. Subsequently, when the coke is cooled, a coherent solid is formed which by appearance is isotropic and has a hardness which is suitable for metallurgical processes.

Coal fines and coal dust, as well as non-caking and weakly caking coals, have been variously treated, such as by adding binders, to improve caking properties. Examples of binders employed in the prior art are coal-derived or petroleum derived carbonaceous materials such as coal extracts, tar, pitch, tar oil, fuel oil, asphalt, crude petroleum extracts, bitumen and the like. However, large amounts of any binder are usually required in order to form a caking coal. Even when only small amounts of additives are required (e.g., solvent-refined coal - see U.S. Pat. No. 2,686,152), they are usually very expensive.

Coal liquids and gases derived from pyrolysis of the coal evidence generally undesirable properties. Coal liquids are unstable and tend to polymerize in a matter of days to form highly viscous liquids and eventually solid tars. Coal gases evidence low heat contents.

SUMMARY OF THE INVENTION

In accordance with the invention, coal products having improved properties upon pyrolysis are formed by a process which comprises (a) treating functionalities having weakly acidic protons in coal by a process selected from the group consisting of alkylation and acylation (sometimes referred to herein as oxygen or O-alkylation and oxygen or O-acylation), and (b) pyrolyzing the treated coal. Weakly acidic protons include phenolic, carboxylic and mercaptan functionalities. The O-alkylation or O-acylation is conveniently carried out by the use of a phase transfer reagent and an alkylating or acylating agent. The phase transfer re-agent, which is recyclable, is by way of example, a quaternary ammonium or phosphonium base ($R_4QOR''$), where each R is the same or different group selected from the group consisting of $C_1$ to about $C_{20}$ alkyl and $C_6$ to about $C_{20}$ aryl; Q is nitrogen or phosphorus; and R'' is selected from the group consisting of hydrogen, $C_1$ to about $C_{10}$ alkyl, aryl, alkylaryl, arylalkyl and acetyl; the alkylating and acylating agents are represented by the formula R'X where R' is a $C_1$ to $C_{20}$ alkyl or acyl group and X is a leaving group selected from the group consisting of halide, sulfate, bisulfate, acetate and stearate, wherein X is attached to a primary or secondary carbon atom.

The O-alkylated or O-acylated coal upon pyrolysis produces a coke. In contrast to the binders used in prior art, which are physically added to coal, only a small amount of the alkylating or acylating material need be added by covalent bonding to the coal to achieve strong caking properties where little or none existed before treatment. Although larger amounts of the alkylating or acylating agent may also be employed (i.e., heavier alkyl or acyl groups with more carbon atoms per alkyl or acyl group) these larger amounts are not always necessary to effect the desired improvement in the caking properties. Coals that are non-caking coals upon pyrolysis form caking coal upon pyrolysis as a consequence of the process of the invention. Coals that are only moderately or weakly caking manifest substantially improved caking strength.

Prior to pyrolysis, the treated coal may be contacted with a solvent to extract soluble coal. Upon pyrolysis of the remaining solid, a coke is formed, which has the caking properties described above.

Further, the O-alkylated or O-acylated coal generates pyrolysates having improved properties. Coal liquids derived by pyrolysis do not polymerize as readily as those derived from non-treated coals and are in general more stable and more rich in hydrogen. Coal gases derived by pyrolysis are also more rich in hydrogen and evidence higher heat content than coal gases derived from non-treated coals.

DETAILED DESCRIPTION OF THE INVENTION

The procedure that follows is given in terms of forming caking coals from non-caking coals such as subbituminous coals upon pyrolysis. However, the procedure is also useful in upgrading weakly or moderately caking coals such as certain bituminous coals.

The process of the invention employed in treating coals to produce caking coals differs from the methods of the prior art in that a deliverate chemical transformation of the coal is accomplished rather than merely a physical blending. For example, the phenolic and carboxylic functional substituents in the coal are chemically altered. These two very polar functional groups are converted to relatively non-polar ethers and esters, respectively. The chemical transformation may be represented as follows:

$$\text{Ar—OH} + \text{R'X} \longrightarrow \text{Ar—OR'}$$

$$\text{Ar—COOH} + \text{R'X} \longrightarrow \text{Ar—COOR'}$$

where R' is a $C_1$ to about $C_{20}$ alkyl or acyl group.

By the process of the invention, caking properties are produced in formerly non-caking coals. By the same process, strongly caking properties are also produced in weakly or moderately caking coals such as certain bituminous coals. Further, coal liquid and gas pyrolysates manifest generally improved properties over untreated coals.

It should be noted that the O-alkylation or O-acylation process of the invention used to produce caking properties in coal is quite opposite in effect to C-alkylation or C-acylation. As disclosed in U.S. Pat. No. 4,092,235, Friedel-Crafts alkylation and acylation, which adds alkyl and acyl groups, respectively, to protonated aromatic carbons, destroys the caking properties of coals.

The O-alkylation or O-acylation of solid coal by reagents which are in liquid solution is greatly influenced by the use of a phase transfer reagent. Such a reagent has both a liphophilic and a hydrophilic portion and is capable of transferring a basic species, —OR", from an aqueous phase to either a solid or liquid organic phase, where R" is either hydrogen or a carbon-bearing functionality. The phase transfer reagent may be generated catalytically, in which case the process is termed a phase transfer catalysis, which is a well-known reaction; see, e.g., Vol. 99, Journal of the American Chemical Society, pp. 3903–3909 (1977). Alternatively, the phase transfer reagent may be generated in a separate step and then used later in the alkylation or acylation reaction. If this latter reaction is employed, then the active form of the reagent may be regenerated in a subsequent step. In either case, the overall chemical transformation on the solid coal is the same. A generalized mechanistic scheme of this transformation is shown below:

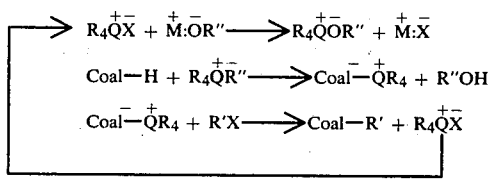

The phase transfer reagent is preferably a quaternary base represented by the formula $R_4QOR''$ where each R is the same or different group selected from the group consisting of $C_1$ to about $C_{20}$, preferably $C_1$ to $C_6$ alkyl and $C_6$ to about $C_{20}$, preferably $C_6$ to $C_{12}$ aryl group; Q is nitrogen or phosphorus, preferably nitrogen, and R" is selected from the group consisting of hydrogen, $C_1$ to about $C_{10}$, preferably $C_1$ to $C_6$ alkyl, aryl, alkylaryl, arylalkyl and acetyl group; more preferably a $C_1$ to $C_4$ alkyl group and most preferably hydrogen. The phase transfer reagent may be generated by reacting the corresponding quaternary salt $R_4QX$ with a metal base MOR" where X is selected from the group consisting of halide, sulfate, bisulfate, acetate and stearate. Preferred is when X is a halide selected from the group consisting of chlorine, bromine and iodine, more preferably chlorine. M is selected from the group consisting of alkali metals, more preferably sodium and potassium. As shown above, the quaternary base is then reacted with the acidic groups on the coal which in turn is reacted with at least one alkylating or acylating agent represented by the formula R'X wherein R' is selected from the group consisting of $C_1$ to about $C_{20}$ alkyl or acyl group and X is as previously defined, as long as X is attached to a primary or secondary carbon atom. Preferably R' is an inert hydrocarbon, that is, a hydrocarbon group containing only hydrogen and carbon although hydrocarbon groups containing other functionality may also be suitable for use herein, even though less desirably. It will be noted that the acidic proton H (hydrogen atom) is usually located on phenolic groups in higher rank coals and on carboxylic groups for lower rank coals. The acidic proton may also be located to a lesser extent on sulfur, nitrogen, etc.

Phase transfer reagents such as quaternary ammonium base ($R_4QOR''$) are very effective in the O-alkylation and O-acylation of coal. These O-alkylation and O-acylation reactions are successful because the —OR" portion of the molecule is soluble in an organic medium. When this base is present in such a medium, it is not solvated by water or other very polar molecules. As an unsolvated entity, it can react as a very efficient proton transfer reagent. For example, $$(coal)\text{-}OH + \overline{O}R'' \rightarrow (coal)\text{-}\overline{O} + R''OH$$

This unsolvated base (also known as a "naked hydroxide" when R" is hydrogen) can have a wide variety of counter ions. Although the counter ion may be a quaternary ammonium or phosphonium species as previously discussed, other examples of counter ions useful in the practice of the invention include "crown ether" complexes of a salt containing the OR" anion and clathrate compounds complexed with a salt containing the OR" anion. Salts represented by MOR", where M is as given above, when complexed with crown ethers, for example, have been previously demonstrated to evidence a reactivity similar to that found for $R_4QOR''$ compounds.

In one embodiment of the process of the invention, a two-phase solid/liquid system comprising the particular coal in liquid suspension is formed. The coal is generally ground to a finely divided state and contains particles less than about ¼ inch in size, preferably less than about 8 mesh NBS sieve size, more preferably less than about 80 mesh. The smaller particles, of course, have greater surface area and thus alkylation or acylation will proceed at a faster rate. Consequently, it is desirable to expose as much surface area as possible without losing coal as fines or as the economics of coal grinding may dictate. Thus, particle sizes greater than about 325 mesh are preferred.

Although not necessary, a solvent may be added if desired. The solvent may be used to dissolve alkylated or acylated carbonaceous product or to dissolve alkylating or acylating agent (especially if the agent is a solid and is comparatively insoluble in water). The solvent may also be used to provide more efficient mixing. Many of the common organic solvents may be employed in any reasonable amount, depending on the desired result.

Inasmuch as there are solid coal particles which never dissolve during the course of the reaction, there may be some concern as to the extent of the reaction on these particles. To verify the complete extent of the reaction, these particles were collected and worked up separately on numerous runs with a wide variety of alkylating agents as well as coals. Infrared spectral analysis of this insoluble portion of the coal reaction mixture showed that in every case, substantially complete alkylation of the hydroxyl group had occurred. This is evidence that the phase transfer reagent must have penetrated the solid coal structure and that the resulting organic salt of the coal must have reacted with the alkylating agent to produce the observed product. Thus, the etherification and esterification reactions are not merely taking place on the surface of the coal but thoughout the entire coal structure as well.

The phase transfer reagent that is used must dissolve in or be suspended in both phases so that it has intimate contact with both the organic and aqueous phases. During the course of the reaction, the phase transfer reagent will then partition itself into both of these phases. Quaternary bases are one class of compounds useful as phase transfer reagents in the practice of the invention and are represented by the formula $R_4QOR''$, where R is an alkyl group having at least one carbon atom and preferably 1 to 20 carbon atoms and more preferably 1 to 6 carbon atoms, or an aryl group having 6 to 20 carbon atoms, preferably 6 to 12 carbon atoms. The lower number of carbon atoms is preferred, since such compounds are more water soluble and can be removed from the alkylated or acylated coal by simple water washing. The R groups may be the same or different. Examples of R groups include methyl, butyl, phenyl, and hexadecyl.

Examples of quaternary bases useful in the practice of the invention include the following:

1. Tetrabutylammonium hydroxide, $(C_4H_9)_4NOH$
2. Benzylhexadecyldimethylammonium hydroxide, $(C_6H_5CH_2)$ $(C_{16}H_{33})$ $(CH_3)_2NOH$
3. Tetrabutylphosphonium hydroxide, $(C_4H_9)_4POH$
4. ADOGEN 464, $(C_8-C_{10})_4NOH$, (ADOGEN 464 is a trademark of Aldrich Chemical Company, Metuchen, N.J.)

The metal base used to convert the quaternary salt to the corresponding base is an alkali metal or alkaline earth metal base such as NaOH, KOH, $Ca(OH)_2$ or $NaOCH_3$. The use of an alkoxide, for example, permits use of the corresponding alcohol in place of water, which may provide an advantage in treating coals for specific applications.

In the case of O-alkylation, the carbon to which the leaving group is attached may be either a primary or secondary carbon atom. Primary carbon halides have been found to react faster than the corresponding secondary halides in a phase transfer or phase transfer catalyzed reaction on carbonaceous materials and are accordingly preferred. While the balance of the carbon-bearing functional group may, in general, contain other moieties, such as heteroatoms, aryl groups and the like, bonding of the carbon-bearing functional group to the phenolic or carboxylic oxygen (or mercaptan sulfur) is through either an $sp^3$ hybridized carbon atom (alkylation) or an $sp^2$ hybridized carbon atom (acylation). Further, a mixture of alkylating agents or acylating agents or a mixture of both may advantageously be employed. Such mixtures are likely to be generated in coal-treating plants in other processing steps and thus provide a ready source of alkylating and/or acylating agents. Examples of alkylating or acylating agents useful in the practice of the invention include ethyl iodide, isopropyl chloride, dimethyl sulfate, benzyl bromide and acetyl chloride.

While alkylating and/or acylating agents are employed in the practice of the invention, alkylating agents are preferred for the following reasons. First, alkylating agents are readily prepared from their hydrocarbon precursors. For example, alkyl halides may be easily prepared by free radical halogenation of alkanes, which is a well-known process. When a system containing more than one alkylating or acylating agent is used, the hydrocarbon precursor is preferably a product stream of a certain cut derived from coal and petroleum processing and the like. This stream may contain minor amounts of components having various degrees of unsaturation which are also suitable for reacting with the penolic and carboxylic groups herein, as long as X (as previously defined) is attached to an alkyl or saturated carbon atom in the resulting alkylating or acylating reagent. Second, acylating reagents are susceptible to hydrolysis. Since water is ever present in coal and is employed in the inventive process, some loss of acylating agent may occur by hydrolysis. In contrast, alkylating reagents do not evidence the same susceptibility to hydrolysis.

If the O-alkylation or O-acylation is carried out by a catalytic process, then the quaternary salt, metal base and alkylating or acylating agent are mixed directly with an aqueous slurry of coal. The quaternary salt catalyst may be present in small amounts, typically about 0.05 to 10% of the amount of coal used; however, greater amounts of catalyst may also be employed. The metal base and alkylating or acylating agent must be present in at least stoichiometric quantities relative to the number of acidic sites (phenolic, carboxylic, etc.) on the coal, but preferably an excess of each is used to drive the reaction to completion. Advantageously, a two-fold excess of both metal base and alkylating or acylating agent are employed; however, a greater excess may be employed. After the reaction, the excess quaternary base and quaternary salt catalyst may be removed from the coal by ample water washing for recycling. Excess metal base will also be extracted into the water wash, and it may be reused. Excess alkylating or acylating agent may be conveniently removed from the treated coal by fractional distillation or by solvent extraction with pentane or other suitable solvent and may be reused.

To cap off all acidic protons in a typical bituminous coal employed in the catalytic process, less than about 5 days are required for 100% conversion, using only a slight excess of alkylating or acylating agent on 80/100 mesh coal under atmospheric pressure and ambient temperature. A greater excess of alkylating or acylating agent will reduce the reaction time considerably.

A faster alkylation or acylation reaction may be obtained in a number of ways, one of which is to add the phase transfer reagent ($R_4QOR''$) directly to the coal, rather than to form this reagent in situ with the reaction in which the coal is alkylated or acylated. When this is done, substantially complete conversion of all the phenolic and carboxylic groups is achieved in a matter of minutes. The amount of quaternary nase added can range from about stoichiometric proportions to about 10 times the total number of acidic sites which are capable of undergoing alkylation or acylation. As before, the quaternary salt that is generated in the alkylation or acylation step may be recovered and recycled by reacting it with fresh metal base to regenerate the quaternary base. By employing this two-step process, there is no contact between alkali metal or alkaline earth metal base and the coal, and the reaction is essentially complete in about one hour.

As an example, in 10 grams of Illinois No. 6 coal, there are 35 mmoles of Ar-OH groups. An excess of a quaternary hydroxide along with an excess of an alkylating agent (about 4 to 5 times each) results in essentially complete alkylation in less than one hour at ambient conditions. In contrast, in the phase transfer catalyzed reaction, there is alkali metal or alkaline earth metal base present so that the alkylation (or acylation) must be carried out in an inert atmosphere, such as nitrogen, to avoid oxidation of the coal. In the case of the non-catalyzed process in which the formation of the transfer reagent is kept separate from the alkylating or acylating reaction, the rate of oxidation of the coal is slow enough and is not competive with the alkylation or acylation reaction. Therefore, another advantage of this non-catalyzed process is that the use of an inert atmosphere such as nitrogen is not required.

The temperature at which the reaction is carried out may range from ambient to the boiling point of the materials used. Increased temperature will, of course, speed up the reaction rate.

The reaction mixture may be stirred or agitated or mixed in some fashion to increase the interface or surface area between the two phases, since there can be aqueous, organic liquid and solid coal phases present.

The reaction is conveniently carried out at ambient pressure, although low to moderate pressures (about 2 to 20 atmospheres) may be employed along with heating to increase the reaction rate.

Once the reagents and solvents if any are removed from the alkylated or acylated coal, infrared analysis may be conveniently used to demonstrate that all the hydroxyl groups have been alkylated or acylated. If the added alkyl or acyl group is IR-active, then the appearance of the appropriate infrared frequency is observed. Other well-known analytical methods may also be employed if desired. The ultimate analysis of percent C, H, N, S and O is altered in a fashion which is consistent with the expected change due to the added alkyl or acyl substituent. For example, the increase in the H/C ratio of O-methylated Illinois No. 6 coal indicates that 4.5 methyl groups per 100 carbon atoms are added to the coal. The H/C ratio of the untreated Illinois No. 6 coal is 0.84 and the H/C ratio after methylation is 0.89.

The thermogravimetric analysis of the methylated coal shows a significant increase in volatile organic content over the untreated coal (38% versus 32%). The solvent extractability of the coal is greatly increased after it is o-alkylated or O-acylated. For example, Illinois No. 6 coal becomes more soluble in common organic solvents after it is oxygen-methylated, as shown in Table I below:

TABLE I

| | Maximum Solubility (at 1 atm) | | |
|---|---|---|---|
| | Toluene | Tetrahydrofuran | Pyridine |
| Untreated Illinois No. 6 Coal | 3% | 17% | 27% |
| O-Methylated Illinois No. 6 Coal | 7% | 22% | 34% |

Coal liquids which are derived by solvent extraction of coal treated in accordance with the invention evidence both improved quality and increased quantity over coal liquids derived from non-treated coal. For example, O-methylation of Illinois No. 6 coal results in 34% solubility in pyridine (as compared to 27% for untreated coal; see Table I). Further, the remaining 66% of the alkylated coal still produces a strong cake upon pyrolysis.

Following treatment of the coal by the process of the invention, the treated coal is pyrolyzed. The conditions of such pyrolyses are conventional and well-known and form no part of this invention.

In the pyrolysis of coal, there are always produced coal liquids and gases. After the process of O-alkylation or O-acylation of a given coal as disclosed herein, the pyrolysis products, as well as the chemical composition of the resultant coal liquids and gases, are changed. For example, a higher hydrogen to carbon ratio is found for the coal liquids and gases which are produced from the pyrolysis of a coal treated in accordance with the invention, as compared to the corresponding untreated coal. As is well-known, a higher H/C ratio renders these liquids and gases more valuable. Further, the coal products following pyrolysis evidence improved stability and compatibility with petroleum products.

Pyrolysis of alkylated or acylated bituminous coal produces greatly improved caking properties in coal which was only moderately caking before the process of this invention was used. O-alkylation or O-acylation of subbituminous coal that is originally a non-caking coal generates on agglomerated coke upon pyrolysis.

EXAMPLES

EXAMPLE 1

Phase Transfer Non-Catalyzed Alkylation

Rawhide subbituminous coal, which is a non-caking coal, was treated as follows:

A slurry of 39.8 g Rawhide coal (−80 mesh) and 300 mmoles (free base) of tetrabutylammonium hydroxide (75% in aqueous solution) were mixed together at ambient temperature and 1 atm pressure for a few minutes. Tetrahydrofuran (200 ml) and 500 mmoles of n-heptyliodide were then added and the reaction mixture was stirred for nearly 3 hrs. The colorless water layer was then separated and fresh water added to wash out any residual quaternary salt from the organic phase, which contained the O-alkylated coal. The washing was continued until the pH of the wash water was neutral and no precipitate formed when silver nitrate was added to the wash water. (A by-product of the alkylation was tetrabutylammonium iodide, which reacted with the silver nitrate to give a precipitate of AgI). The excess heptyliodide, water and THF were removed by vacuum distillation at 100°–110° C. The alkylated coal was then analyzed. Infrared analysis revealed essentially complete elimination of the hydroxyl band (3100–3500 $cm^{-1}$), as well as incorporation of the alkyl ether functionality (1000–1200 $cm^{-1}$) and ester carbonyl functionality (1700–1735 $cm^{-1}$).

The alkylated coal was then pyrolyzed in the following manner: one to two grams of coal were rapidly heated in a quartz tube to 600° C. under a nitrogen atmosphere. The coal liquids were condensed out in a dry ice trap. The weight percent of the gas formed was determined by difference (wt. gas = wt. coal used minus wt. of solid and liquid pyrolysates). Using this procedure, the coke produced from the oxygen-alkylated coal was compared to the coke formed during the pyrolysis of the same coal which had not undergone alkylation. There was a significant improvement in cake quality of the coke formed from a coal which originally was a noncaking coal. The non-alkylated and alkylated coals were also tested to determine the free swelling index FSI (ASTM D720). The coke strength and FSI are given in Example 36 below.

EXAMPLES 2–7

Phase Transfer Non-Catalyzed Alkylation

The following runs were made, employing the procedure set forth in Example 1. In each reaction, the quaternary base was tetrabutylammonium hydroxide. The base was present in at least stoichiometric amount of the number of acidic protons on the coal sample in the case of Rawhide and 2:1 in the case of Illinois No. 6.

TABLE II

| PHASE TRANSFER NON-CATALYZED REACTIONS | | | |
|---|---|---|---|
| Example | Coal(1) | R'X(2) | Reaction Time, hr. |
| 2 | Illinois #6 (80/100) | $CH_3I$, 200% | 1 |
| 3 | Illinois #6 (−80) | $C_4H_9I$, 200% | 3 |
| 4 | Illinois #6 (80/100) | $C_7H_{15}I$, 200% | 3 |
| 5 | Rawhide (80/100) | $CH_3I$, 200% | 1 |
| 6 | Rawhide (80/100) | $C_4H_9I$, 200% | 3 |
| 7 | Rawhide (80/100) | $C_7H_{15}I$, 200% | 3 |

Notes:
(1)Mesh size is indicated in parentheses
(2)Weight percent relative to coal

TABLE III

| PHASE TRANSFER CATALYZED REACTIONS | | | | | |
|---|---|---|---|---|---|
| Example | Coal(1) | Solvent | Catalyst(2) | Caustic(3) | R'X(4) |
| 9 | Ill.#6 (−300) | Toluene | B, 10% | KOH, 50% | $CH_3I$, 700% |
| 10 | Ill.#6 (−300) | Toluene | B, 10% | KOH, 50% | $C_2H_5I$, 500% |
| 11 | Ill.#6 (−100) | Toluene | B, 10% | KOH, 50% | $CH_3I$, 680% |
| 12 | Ill.#6 (−100) | Toluene | B, 10% | NaOH, 50% | $C_7H_{15}I$, 414% |
| 13 | Ill.#6 (−100) | Toluene | B, 10% | NaOH, 50% | Allylbromide, 420% |
| 14 | Wyodak (−100) | Toluene | B, 10% | NaOH, 50% | Allylbromide, 420% |
| 15 | Wyodak (−100) | Toluene | B, 10% | NaOH, 50% | $CH_3I$, 680% |
| 16 | Wyodak (−100) | Toluene | B, 10% | NaOH, 50% | Crotylbromide, 315% |
| 17 | Wyodak (−100) | Toluene | B, 10% | NaOH, 50% | $C_7H_{15}$, 414% |
| 18 | Wyodak (−100) | Toluene | B, 10% | NaOH, 50% | Cinnamylbromide, 500% |
| 19 | Ill.#6 (−100) | Toluene | B, 10% | NaOD, 40% | $CD_3I$, 137% |
| 20 | Ill.#6 (−100) | Toluene | B, 10% | NaOH, 50% | Propargylbromide, 375% |
| 21 | Wyodak (−100) | Toluene | B, 10% | NaOH, 50% | Propargylbromide, 624% |
| 22 | Wyodak (−100) | Toluene | B, 5% | NaOH, 50% | $(CH_3)_2SO_4$, 478% |
| 23 | Texas Lignite (−100) | Toluene | B, 10% | NaOH, 50% | Allylbromide, 450% |
| 24 | Ill.#6 (−100) | Toluene | B, 3.3% | NaOH, 12% | $C_4H_9Cl$, 427% |
| 25 | Ill.#6 (−100) | Toluene | B, 10% | NaOH, 20% | $C_3H_7I$, 388% |
| 26 | Ill.#6 (−80) | Xylenes | B, 10% | NaOH, 20% | 1-bromo-2-methyl, propane, 351% |
| 27 | Ill.#6 (−80) | Xylenes | A, 10% | NaOH, 20% | 2-iodopropane, 461% |
| 28 | Ill.#6 (−80) | Xylenes | T, 10% | NaOH, 12% | $CH_3I$, 540% |
| 29 | Ill.#6 (−80) | Toluene | T, 10% | NaOH, 12% | $CH_3I$, 50% |
| 30 | Ill.#6 (−80) | Toluene | T, 5.8% | NaOH, 12% | $CD_3I$, 72% |
| 31 | Ill.#6 (80/100) | Toluene | T, 5% | NaOH, 20% | $CD_3I$, 50% |
| 32 | Ill.#6 (80/100) | Toluene | T, 5% | NaOH, 20% | $C_4H_9I$, 100% |
| 33 | Ill.#6 (80/100) | THF | T, 5% | NaOH, 20% | $C_4H_9I$, 100% |
| 34 | Ill.#6 (300/325) | Toluene | T, 5% | NaOH, 20% | $C_4H_9I$, 100% |
| 35 | Ill.#6 (300/325) | THF | T, 5% | NaOH, 20% | $C_4H_9I$, 100% |

Notes:
(1)Mesh size is indicated in parentheses.
(2)B is benzylhexadecyldimethylammonium chloride, A is ADOGEN 464 and T is tetrabutylammonium iodide; weight percent is relative to coal.
(3)Weight percent of metal base in water.
(4)Weight percent relative to coal.

Illinois No. 6 coal is a weakly caking coal, while Rawhise is a non-caking coal. In each case, the caking properties were considerably improved; see Example 36, below.

EXAMPLE 8

Phase Transfer Catalyzed Alkylation

Illinois No. 6 coal (weakly caking coal) was treated as follows:

Twenty grams of Illinois No. 6 coal (80/100 mesh), 50 ml of a 50% aqueous NaOh solution, 150 ml of toluene, 70 mmoles of $CH_3I$ and 1 g of tetrabutylammonium chloride were mixed together under a nitrogen atmosphere (the order of addition was not important). After five days, the aqueous layer was separated and the organic phase washed with water until the unreacted sodium hydroxide and catalyst were extracted out of the toluene. The toluene, water and excess iodomethane were removed under vacuum at 100° C. The O-alkylated coal was then analyzed. Infrared analysis revealed essentially complete elimination of the hydroxyl band (3100–3500 $cm^{-1}$), as well as incorporation of the alkyl ether functionality (1000–1200 $cm^{-1}$) and incorporation of the ester carbonyl functionality (1700–1735 $cm^{-1}$).

The alkylated coal was pyrolyzed as in Example 1. The cake strength and FSI are given in Example 36, below.

EXAMPLES 9–35

Phase Transfer Catalyzed Alkylation

The following runs were made, employing the procedure set forth in Example 8.

EXAMPLE 36

Results of FSI and Coke Formation Studies

The results of the FSI and cake strengths of coke formed from several of the alkylated and untreated coals are presented below:

| Material | FSI | Cake Strength |
|---|---|---|
| Illinois #6 Coal | 2 | weak |
| O-Methylated Ill. #6 | 3.5 | strong |
| O-Butylated Ill. #6 | 5 | strong |
| O-Heptylated Ill. #6 | 7 | strong |
| Rawhide Subbituminous Coal | — | free flowing powder |
| O-Methylated Rawhide Coal | 2 | moderate |
| O-Butylated Rawhide Coal | 3 | strong |

EXAMPLE 37

Results of Pyrolysis

The percent of each pyrolysate of various coals and coal alkylates are presented below:

| Pyrolysis at 600° C. | | | | |
|---|---|---|---|---|
| | Pyrolysate | | | |
| Material Pyrolyzed Coal Designation | % Coke | % Liquid | % Gas | H/C Ratio |
| Illinois #6 (HVCB) | 32 | 26 | 42 | 0.85 |
| O-Methylated Ill. #6 | 37 | 28 | 35 | 0.90 |
| Rawhide Subbituminous | 43 | 21 | 36 | 0.84 |
| O-Methylated Rawhide | 47 | 26 | 27 | 0.99 |
| Wyodak Subbituminous | 44 | 6 | 50 | 0.84 |
| O-Allylated Wyodak | 45 | 21 | 34 | 0.89 |

Treatment of coal in accordance with the invention is thus seen to improve the properties.

What is claimed is:

1. A method for forming coal products having improved properties upon pyrolysis, by oxygen-alkylation and/or oxygen-acylation, which method comprises: (a) treating the coal with a solution comprising:

(aa) at least one quaternary base represented by the formula $R_4QOR''$ were each R is the same or different group selected from the group consisting of $C_1$ to about $C_{20}$ alkyl and $C_6$ to about $C_{20}$ aryl; Q is nitrogen or phosphorus; and R'' is selected from the group consisting of hydrogen, $C_1$ to about $C_{10}$ alkyl, aryl, alkylaryl, arylalkyl and acetyl; and (ab) at least one compound represented by the formula R'X where R' is a $C_1$ to $C_{20}$ alkyl or acyl group and X is selected from the group consisting of halides, sulfates, bisulfates, acetates and stearates; wherein X is attached to a primary or secondary carbon atom; and (b) pyrolyzing the treated coal.

2. The method of claim 1 wherein the coal is a non-caking subbituminous coal.

3. The method of claim 1 wherein the coal is a weakly or moderately caking bituminous coal.

4. The method of claim 1 wherein prior to pyrolysis, the treated coal is contacted with a solvent to extract soluble coal.

5. The method of claim 1 wherein R'' is a $C_1$ to $C_4$ alkyl group or hydrogen.

6. The method of claim 5 wherein R'' is hydrogen.

7. The method of claim 1 wherein Q is nitrogen.

8. The method of claim 6 wherein Q is nitrogen.

9. The method of claim 1 wherein each R is the same or different $C_1$ to $C_6$ alkyl group.

10. The method of claim 8 wherein each R is the same or different $C_1$ to $C_6$ alkyl group.

11. The method of claim 1 wherein R' is a $C_1$ to $C_4$ inert hydrocarbon group.

12. The method of claim 10 wherein R' is a $C_1$ to $C_4$ inert hydrocarbon.

13. The method of claim 1 wherein X is selected from the group consisting of chlorine, bromine and iodine.

14. The method of claim 12 wherein X is selected from the group consisting of chlorine, bromine and iodine.

15. The method of claim 14 wherein X is chlorine and R' is a methyl group.

16. The method of claim 1 wherein the amount of quaternary base ranges from about a stoichiometric amount to about 10 times the total number of acidic sites on the coal.

17. The method of claim 15 wherein the amount of quaternary base ranges from about a stoichiometric amount to about 10 times the total number of acidic sites on the coal.

18. The method of claim 1 wherein R'X is present in at least a stoichiometric amount relative to the number of acidic sites on the coal.

19. The method of claim 17 wherein R'X is present in at least stoichiometric amounts relative to the number of acidic sites on the coal.

20. The method of claim 1 wherein a quaternary salt represented by the formula $R_4OX$ is reacted with an alkali or alkaline earth metal base represented by the formula MOR'' to form the corresponding quaternary base, wherein M is an alkali or alkaline earth metal.

21. The method of claim 19 wherein a quaternary salt represented by the formula $R_4QX$ is reacted with an alkali or alkaline earth metal base represented by the formula MOR'' to form the corresponding quaternary base, wherein M is an alkali or alkaline earth metal.

22. The method of claim 20 wherein the reaction is carried out catalytically.

23. The method of claim 19 wherein the amount of quaternary salt is a catalytic amount ranging from about 0.05 to 10 wt. % of the coal.

24. The method of claim 20 wherein the quaternary base is formed separate from the alkylation or acylation reaction.

25. The process of claim 24 which is repeated at least once.

* * * * *